United States Patent [19]

Plummer

[11] Patent Number: 4,499,164

[45] Date of Patent: Feb. 12, 1985

[54] IMAGE CARRYING MEDIA EMPLOYING AN OPTICAL BARRIER

[75] Inventor: William T. Plummer, Concord, Mass.

[73] Assignee: Polaroid Corporation, Cambridge, Mass.

[21] Appl. No.: 606,580

[22] Filed: May 3, 1984

Related U.S. Application Data

[63] Continuation-in-part of Ser. No. 480,287, Mar. 30, 1983, abandoned, which is a continuation-in-part of Ser. No. 372,618, Apr. 28, 1982, abandoned.

[51] Int. Cl.[3] ..... G03C 1/40; G03C 5/54; G03C 1/10; G03C 7/00

[52] U.S. Cl. ..... 430/14; 430/212; 430/215; 430/220; 430/236; 430/227; 430/229; 430/523; 430/950; 428/409

[58] Field of Search ..... 430/212, 215, 220, 227, 430/229, 523, 14, 950, 236; 428/409

[56] References Cited

U.S. PATENT DOCUMENTS 3,445,228 5/1969 Beavers et al. ..... 430/220
3,706,557 12/1972 Arond ..... 430/215
4,269,916 5/1981 Bilofsky et al. ..... 430/220
4,298,674 11/1981 Land et al. ..... 430/220
4,367,277 1/1983 Chiklis et al. ..... 430/227

OTHER PUBLICATIONS

"Multiple Internal Reflections . . . Prints", Williams et al., *J. of Optical Soc. of Am.,* vol. 43, No. 7, 7/1953, pp. 595–599.

"Reflection Density . . . Prints", Ohta, *Photo. Sci. & Engrg.,* vol. 16, No. 5, Sep./Oct. 1972, pp. 334–340.

"Color Reproduction . . . Prints", Ohta, *J. of Applied Photo. Engrg.,* vol. 2, No. 2, Spring 1976, pp. 75–81.

*Primary Examiner*—Richard L. Schilling
*Attorney, Agent, or Firm*—Francis J. Caufield

[57] ABSTRACT

An optical barrier layer for use in reflection type image carrying media of the type wherein a thin transparent image receiving layer includes an image which is viewed through one side of the image receiving layer with ambient light that is reflected from a light scattering layer located on the other side of the image-receiving layer. The optical barrier layer is a thin, transparent layer located between the image receiving layer and the light scattering layer and operates to minimize nonlinear density effects of multiple internal reflections.

10 Claims, 5 Drawing Figures

IMAGE CARRYING MEDIA EMPLOYING AN OPTICAL BARRIER

BACKGROUND OF THE INVENTION

1. Cross-reference to Related Applications

This is a continuation-in-part of U.S. patent application Ser. No. 480,287, filed Mar. 30, 1983, now abandoned, which is in turn a continuation-in-part of U.S. patent application Ser. No. 372,618, filed April 28, 1982 and now abandoned.

2. Field of the Invention

This invention in general relates to multilayered image carrying media and in particular to an improvement in reflection type image carrying media in which an image is viewed against a light scattering background.

3. Description of the Prior Art

Multilayered image carrying media in which an image formed therein is viewed against a light scattering background are known. Such media are generally structured as a series of thin layers overlying one another and typically include a transparent image-receiving layer or layers in which the image is formed by an imagewise and depthwise distribution of image forming components. One surface of the image-receiving layer is usually in contact with a light scattering layer against which the image is viewed through the other surface of the image-receiving layer. For purposes of viewing, the image is illuminated by ambient light which first passes through the viewing side of the image-receiving layer and image after which it is reflected from the light scattering layer and then in part is transmitted back through the image and image-receiving layer to the viewer.

Figure 1:
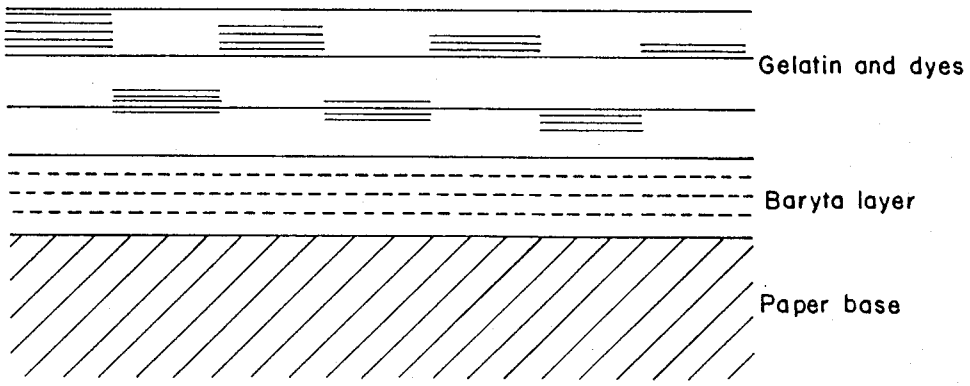

A well-known example of such multilayered image carrying media is the photographic color print which typically has the structure shown diagrammatically in FIG. 1. As can be seen in FIG. 1, the usual color print structure comprises a base of high quality white paper which carries a baryta layer. The baryta, largely barium sulfate powder suspended in gelatin, operates as an efficient diffuse reflector. The image forming layers are coated on the baryta and typically comprise either three separate layers containing cyan, magenta, and yellow dye components or, in the case of imbibition processes, a single dyeable gelatin layer which takes up all three image dyes. Color prints thus structured can be thought of as color transparencies inoptical contact with a diffuse white reflector.

One of the problems associated with color prints is that the reflection densities seen by the observer (or measured) are nonlinear and not nearly proportional to dye concentration as is the case with transparencies. This is due to first surface reflections and to internal reflection or multiple internal reflections within the dye-containing layers.

The effects of multiple internal reflections in color prints has been modeled by Williams and Clapper, *Journal of the Optical Society of America,* vol. 43, no. 7, 595 (1953). Their treatment accounts for staining of highlights, increase in maximum density, shortened exposure latitude, loss of sharpness, and color desaturation from this mechanism. These ideas have also been advanced by a number of other people; notably N. Ohta, *Photographic Science and Engineering,* vol. 16, no. 5 (1972), who has worked out some color gamuts in detail.

However, it is believed that the previous work on multiple internal reflections lacks an important feature which is believed to be significant in certain kinds of color prints. This feature relates to the proximity of the image receiving layer to the light scattering layer or pigment as the case may be. With a separation of only a few wavelengths of visible light between the pigment scattering grains and the ultimate location of the image dyes, these dyes can become unwelcome participants in the multiple rescattering of light between pigment grains. Without the extreme proximity, all light held in the pigment layer by total reflection at the pigment boundary would be free of dye absorption: only light leaving the pigment and penetrating the entire thickness of the dye receiving layer or layers is affected by the dyes. But in cases where the dyes are very close to the pigment layer, a new consideration is introduced which, it is believed, has not heretofore been recognized and which makes the multiple internal reflection problem more severe as will subsequently be described in the detailed disclosure.

Thus, it is a primary object of the present invention to provide improved structure for multilayered image carrying media in which an image is formed near a reflecting background against which it is viewed.

Other objects of the invention will in part be obvious and will in part appear hereinafter.

The invention accordingly comprises the products possessing the construction, combination and arrangement of elements exemplified in the following detailed disclosure and methods or processes inherent in their use.

INTRODUCTION

The present invention relates to the provision of an optical barrier layer in reflection type multilayered image carrying media, such as photographic color prints, for purposes of minimizing the effects of multiple internal reflections in cases where the image forming components, which may be dyes, are at or nearly at the interface between a transparent image-receiving layer and a light scattering layer against which the image is viewed by ambient light reflected from the light scattering layer. To fully understand the nature and advantages of the invention, however, the problem it solves will first be illustrated by considering the simple multilayered image carrying medium shown in FIG. 2 and designated at 10. Here, the structure of the medium 10 is quite general from an optical point of view, it being understood that the various layers shown may be provided in a variety of wellknown ways through the use of appropriate chemicals and associated processes.

The image medium 10 can be seen to comprise an image receiving layer 12 having an index of refraction, n, and including therein an image formed of dyes arranged in a thin layer at or nearly at the interface between the image receiving layer and a light scattering layer 14 which may be formed, for example, of $TiO_2$ pigments. The light scattering layer 14 has an index of refraction, m, and diffusely reflects ambient light which illuminates the image for viewing purposes.

The pigment in the light scattering layer 14 can be considered a thorough isotropic scatterer of light so that the layer 14 can be considered a Lambert reflector, and light within the pigment layer 14 is rescattered from grain to grain many times after which it emerges. The emergent light may be in one of three forms:

I. At small angles, $\theta_1$, from the perpendicular light passes through the layer 12 and through any additional layers above, an antireflection coating for example, and reaches the outer air.

II. At or beyond a certain critical angle, $\theta_{1c}$, defined by the bulk refractive index of the pigment mixture, emerging light passes through the dye layer, through all overlying transparent layers, but is redirected by total reflection at the air interface, and returns to the pigment. Note that the ray at the critical angle in the pigment will assume the local critical angle in each layer it traverses.

III. Beyond a second critical angle, $\theta_{2c}$, defined by the ratio of refractive index between the pigment layer (normally rather high) and the adjacent dyed layer, light will be totally reflected back into the pigment without penetrating the dyed layer in the familiar way. Normally this form of emergence has been neglected, and it is the purpose here to account for it.

The model developed by Williams and Clapper, supra, depends totally on forms I and II of light emergence. Specifically, the ratio of II (the internally reflected light) to the sum of I and II (viewed light plus internally reflected light) is the integrated term upon which their mathematical treatment develops.

A Lambert diffuse reflector has a remarkable property: it remains a Lambert reflector as it is immersed in a succession of transparent layers, despite the action of Snell's law. This happens because the differential form of Snell's law is the ratio of the cosines of the internal and external angles.

Figure 2:
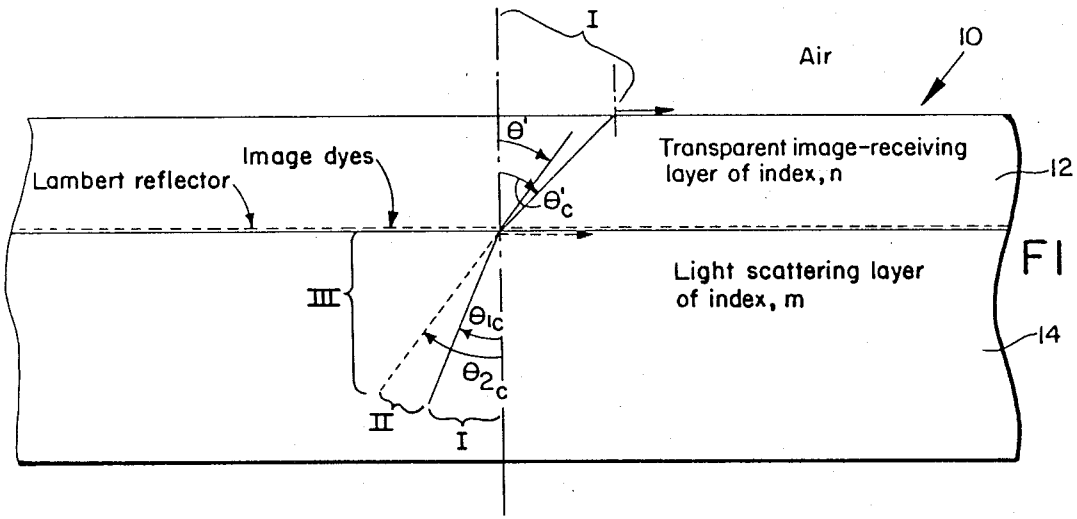
FIG. 2 (Prior Art)

In FIG. 2, the regions I, II, and III correspond to the three kinds of emergent light. Since the pigment layer 14 is a thorough isotropic scatter of light, an observer immersed in the clear layer 12 would see the same brightness emitted by the surface at all angles, so the amount of light passed by a unit area of the pigment surface in any one direction would be weighted by the Lambert foreshortening cosine.

If we integrate within the layer of index, n, to determine how much light gets out (form I) compared to the total entering the layer (form I plus form II) we have:

$$\frac{2\pi \int_0^{\theta'_c} (\cos\theta')\sin\theta' d\theta'}{2\pi \int_0^{\pi/2} (\cos\theta')\sin\theta' d\theta'} = \frac{\pi\sin^2\theta'_c}{\pi\sin^2\left(\frac{\pi}{2}\right)} = \frac{1}{n^2}$$

If we integrate within the pigment layer, of index m, to find the same ratio, we again simply use the cosine weighting factor, and have:

$$\frac{2\pi \int_0^{\theta_1} \cos\theta \sin\theta d\theta}{2\pi \int_0^{\theta_2} \cos\theta \sin\theta d\theta} = \frac{\pi\sin^2\theta_1}{\pi\sin^2\theta_2} = \frac{1/m^2}{(n/m)^2} = \frac{1}{n^2}$$

Since the same two quantities of light are being compared, the ratio is of course the same. Note that m, the bulk refractive index of the pigment, drops out of this model. It is masked by the clear layer of index n above it.

The fraction of "emergent" light reflected at the n/m boundary is then:

$$1 - \frac{2\pi \int_0^{\theta_2} \cos\theta \sin\theta d\theta}{2\pi \int_0^{\pi/2} \cos\theta \sin\theta d\theta} = 1 - \frac{\pi\sin^2\theta_2}{\pi\sin^2\left(\frac{}{2}\right)} = 1 - \left(\frac{n}{m}\right)^2$$

Additional layers piled onto the top of this structure delay the eventual reflection but do not change the angles discussed so far, and so do not change these ratios.

To take an example, let $m \approx 2.4$, and $n \approx 1.546$. Then, the ratio of (form I) emergence to (form I plus form II) is $1/n^2 = 0.418$ and some 0.58 of the light striking the pigment surface from below is totally reflected, from $1-(n/m)^2$. The total light budget upon "leaving" the pigment is:

I 0.174 into air

II 0.241 reflected at air surface

III 0.585 reflected at pigment surface

If done a little more accurately, with inclusion of the small reflectivity of each boundary within the critical angle, the 0.174 would drop a few points and the 0.585 would rise a few points.

Insofar as the form III light undergoes no dye absorption we can merely ignore it, in the footsteps of Williams and Clapper, for it will be scattered again by the pigment and will return to the boundary for another try.

Unfortunately, some absorption does occur upon total reflection if the dyes are near enough. For example, if the receiving layer is distributed at 100 mg/ft.$^2$, it would have a thickness of 1.08 micron for a specific gravity of 1. For a specific gravity of about 1.2 it would be 0.9 micron, or 1.6 vacuum wavelengths, or 2.5 wavelengths in this material, or 3.9 wavelengths of light in the high-index pigment. Based on some previous work on attenuated total reflection done by H. J. Harrick and published in his book, Internal Reflective Spectroscopy, John Wiley and Sons, Inc., NY (1967), exactly at the critical angle ($\theta_2 = 40.2°$) the reflected light "penetrates" this entire thickness and more. At 41° the penetration is down to about 1 wavelength. At 45° it is down to about 0.5 wavelength, at 50° about 0.25, but even at 90° is still more than 0.2 wavelength. The effective thickness for absorption (Harrick pages 46 and 47, curve 7) is more representative of the situation, and decreases more slowly. The perpendicular and parallel polarized components drop to about 0.5 wavelength at 80° and 85°. These effective thicknesses are small compared with the 8 or more wavelengths of the most direct in-and-out passage of form I. But at least three times as much light is present in form III, the solid angles are large, and so the potential contribution of this type of absorption is significant. The actual amount depends upon how the dye is distributed across the thickness of the receiving layer.

DESCRIPTION OF THE INVENTION

Figure 3:
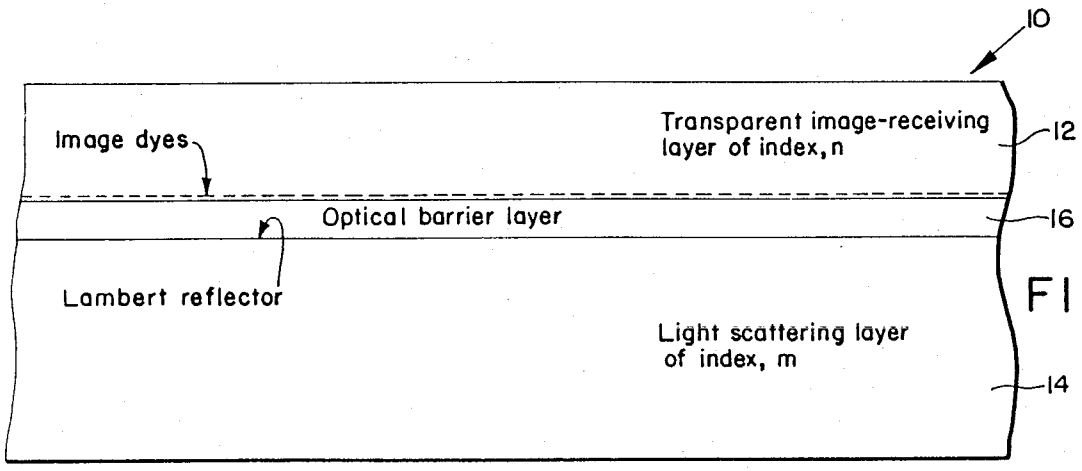

The most effective correction for this problem is to incorporate a clear, preferably dye-permeable, chemically inert, permanent, optical barrier layer (16) between the pigment and the dye receiving layer as shown in FIG. 3. Any thickness is helpful, and most of the benefit should be achieved at 30 to 50 mg/ft.$^2$. A low index is most advantageous, but even an index of 1.5 or 1.6 would relieve the attenuated total reflection problem. The optical barrier layer 16 must be dimensionally stable, and for this purpose is preferably a hardened material. Examples of materials suitable for such a layer would be hardened gelatin, cross-linked polyacrylamide, or cross-linked hydroethylcellulose. A few wavelengths thick or more is preferred but even a thickness of 0.5 micrometers would work. It is believed that no previous consideration has been given to this problem, nor has the optical barrier as a solution to it been proposed.

To be more quantitative about the effectiveness of the optical barrier layer 16 a mathematical model has been worked out beginning with the Williams and Clapper result. It is slightly simplified to ignore non-total reflections where they occur, and to ignore absorption within the pigment layer, but these omissions will not change the results much. The Williams and Clapper result rewritten can be shown to be:

$$R = \frac{t^{(1+n/\sqrt{n2-.5})}/n^2}{1 - 2\int_{\sin^{-1}(1/n)}^{\pi/2} t^{2\sec\theta} \sin\theta \cos\theta \, d\theta}$$

Here n is the index of the image receiving layer 12 and R is the apparent diffuse reflectivity (0° and 45°) geometry of the print when t is the one way transmission through the image-receiving layer 12.

To incorporate the absorption during total reflection at the pigment boundary, a new expression has been derived where:

$$R = \frac{t^{(1+n/\sqrt{n2-.5})}/m^2}{1 - 2\int_{\sin^{-1}(1/m)}^{\sin^{-1}(n/m)} t^{2\sec\theta'} \sin\theta \cos\theta \, d\theta - 2\int_{\sin^{-1}(n/m)}^{\pi/2} t^{w(\theta,\lambda,n/m)\beta} \sin\theta \cos\theta \, d\theta}$$

Here m is the bulk index of the pigment layer (1.68 wet to 2.4 dry), $\theta'$ is related to $\theta$ by $m\sin\theta = n\sin\theta'$, and $w(\theta, \lambda, n/m)$ is the variation of "effective thickness" with angle and index as derived by Harrick. If, for example, $n=1.55$ and $m=2.4$, a useful approximation for w, obtained from Harrick's graphs at pp. 46–47, FIGS. 17 and 18, curve 7, is $w=0.80/(\theta-39°)$, with w in units of $\lambda/m$.

When simplified by a change of variable and substitution of some numbers, the new expression becomes $$R = \frac{t^{2.13}/(2.4)^2}{1 - .415\int_{.7032}^{\pi/2} t^{2\sec\theta'} \sin(2\theta')d\theta' - \int_{.7002}^{\pi/2} t^{\beta w(\theta)} \sin(2\theta)d\theta}$$

Figure 4:
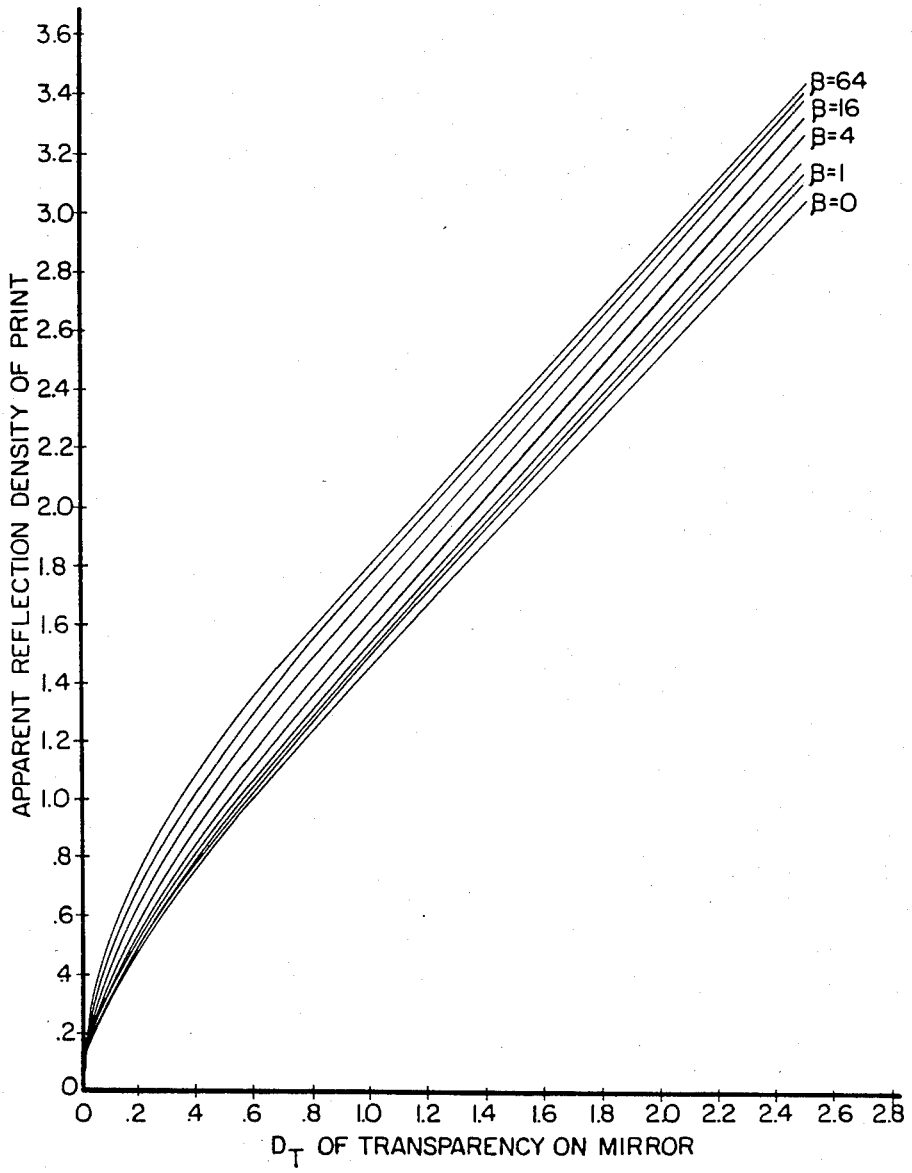

The integrals may now be carried out numerically for any desired combination of t and $\beta$. The values of t simply trace out the range of densities to be investigated, and may be thought of as a coupling coefficient, controlled by how localized the dye may be in the bottom part of the receiving layer 12 as shown in FIG. 4 wherein the abcissa represents the amount of dye needed to achieve the density, $D_t$, against a 100% reflecting mirror. For any given t, more localized dye will correspond to higher $\beta$. When either $\beta=0$ or $w=0$, the new expression reduces to the Williams-Clapper formula.

Some conclusions can be drawn now. The new contribution can have an enormous effect on maximum density when $\beta$ is large. For small $\beta$, the effect on the film characteristic curve is to raise the higher density somewhat and steepen the slope. This effect is strongly wavelength-dependent through the effective thickness, w, so density is increased more for red light than for blue. For the foregoing reasons, the addition of 30 to 50 mg/ft.$^2$ of barrier layer should lower the red maximum density substantially, the green somewhat less, and the blue least of all. This barrier layer may also reduce color changes as a print matures, and may reduce any color irregularity being introduced by differences in dye location within the image-receiving layer.

In photographic color prints, the attenuated total reflection concern is less if the pigments have lower index (such as baryta), and may be entirely negligible if the image-receiving layer 12 is very much thicker than the penetration depth of light reflected at the pigment-image-receiving layer boundary.

Figure 5:
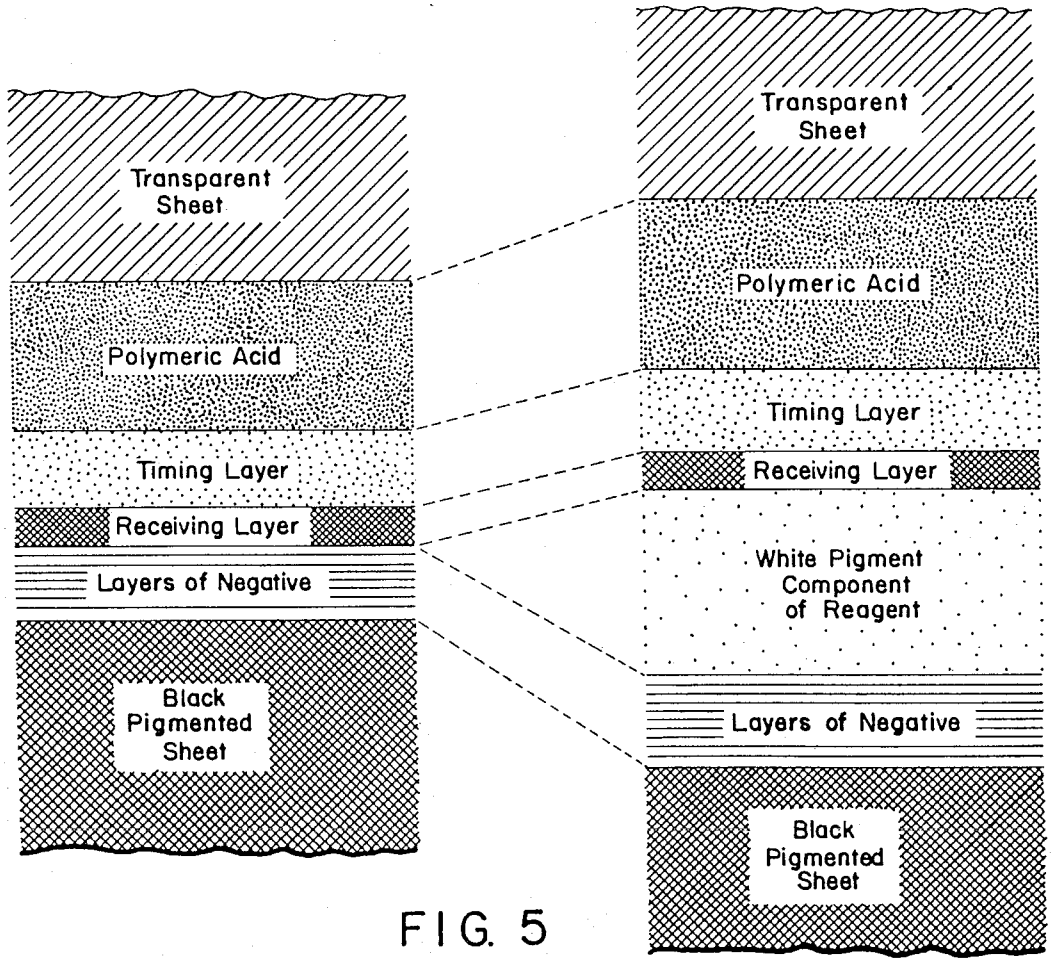

It will be appreciated by those skilled in the photographic arts that the optical barrier layer of the present invention may be incorporated in a variety of multilayered film structures in which image forming components are located within a few wavelengths of a light scattering layer against which the image is viewed for purposes of reducing the effects of multiple internal reflections. For example, the optical barrier layer may be incorporated in self-processable film into structures of the type described in U.S. Pat. No. 3,415,644 issued on Dec. 10, 1968 to Edwin H. Land. Here, photographic products and processes are described in which a photosensitive element and an image-receiving element are maintained in fixed relationship prior to exposure, and this relationship is maintained after processing and image formation. In those type products and processes, which are shown diagrammatically before and after processing in FIG. 5, the final image is viewed through a transparent (support) element against a reflection, i.e., white background. Photoexposure is made through the transparent element and application of a processing composition provides a layer of light-reflecting material to provide a white background for viewing the final image through the transparent support. The light-reflecting material is preferably titanium dioxide which inter alia provides an opacifying function. If the image forming components in such film unit structures were located in the image-receiving layer within a few wavelengths of the titanium dioxide reflecting layer, multiple internal reflection effects could be significant for the reasons discussed above and would be minimized by placing the optical barrier layer of the invention between the image-receiving layer and the titanium dioxide background. This would preferably be accomplished by providing a barrier layer a few wavelengths thick over the image-receiving layer. In film structures of this type, the optical barrier layer (16) is preferably chemically inert and permeable with respect to dyes which need to diffuse therethrough to form the image, but impermeable with respect to the pigments included in the light scattering layer. It will also be appreciated that the optical barrier layer (16) must after processing retain its integrity as a layer to provide its optical effect. The materials mentioned hereinbefore have these characteristics and may be applied as layers in well-known manners.

Other applications for the optical barrier layer in multi-layered image-carrying media will be obvious to those skilled in the art based on the teachings of the present invention. Therefore, it is intended that all matter contained in the above description or shown in the accompanying drawings shall be interpreted as illustrative and not in a limiting sense.

What is claimed is:

1. An image carrying medium comprising:

a thin transparent layer for receiving image-forming components, said image-receiving layer having a given index of refraction;

a plurality of light-absorbing image forming components distributed imagewise of said image-receiving layer defining an image thereover and located at or nearly at one surface of said image-receiving layer so as not to be disposed at or nearly at the other surface of said image-receiving layer, said image being viewable through the other surface of said image-receiving layer;

a permanent, hardened, substantially chemically inert, clear optical barrier layer in contact with said one surface of said image-receiving layer, said optical barrier layer having an index of refraction which is no greater than that of said image-receiving layer; and a light scattering pigment layer in direct contact with said optical barrier layer and having an index of refraction higher than that of said optical barrier layer, said image-carrying medium being structured so that said image thereof is viewed through said other surface of said image-receiving layer against said light scattering pigment layer and wherein, for purposes of viewing, said image is illuminated by ambient light which first passes through said image-receiving layer and image and then is partially reflected from said light scattering pigment layer after which part of said reflected light is transmitted back through said optical barrier layer, said image, and said image-receiving layer to the viewer, said optical barrier layer operating to reduce the amount of light absorption which would otherwise occur within said image forming components absent said optical barrier layer whereby, when said image is viewed, its highlights are brightened and its tone reproduction improved compared with the appearance of said image absent said optical barrier layer.

2. An image carrying medium in which an image may be formed of light absorbing image-forming components, said medium comprising:

a thin, transparent image-receiving layer having a given index of refraction and adapted to have said image formed by said image-forming components at or nearly at one surface thereof so as not to be disposed at or nearly at the other surface thereof;

a light scattering pigment layer having an index of refraction higher than said given index of refraction, said image for viewing purposes being illuminated by ambient light which first passes through the other surface of said image-receiving layer, then through said image-forming components and then reflected from said light scattering layer back through said image-forming components and out through said image-receiving layer, a portion of said ambient light passing into said medium being absorbed by said image-forming components subsequent to its being reflected by said light scattering layer; and a permanent, hardened, chemically inert, transparent optical barrier layer located between said light scattering layer and said image-forming components, said optical barrier layer being composed of a material which is permeable with respect to said image-forming components so that said image-forming components may be diffused therethrough in the process of forming said image, which is impermeable with respect to the pigments of said light scattering layer so that they cannot diffuse therethrough, and which has an index of refraction no greater than that of said light scattering layer, said optical barrier layer operating to reduce the amount of light absorption which would otherwise occur within said image-forming components absent said optical barrier layer, whereby, when said image is viewed, its highlights are brightened and its tone reproduction improved compared with the appearance of said image absent said optical barrier layer.

3. A diffusion transfer process film unit comprising:

a sheet-like element including photosensitive and image-forming components;

a pod of processing fluid adapted to selectively release said processing fluid across said film unit and into contact with said photosensitive and image-forming components after exposure thereof;

a thin, transparent image-receiving layer having a given index of refraction and adapted to have an image formed at or nearly at the surface thereof facing said sheet-like element by image-forming components diffusing from said sheet-like element after exposure and the treatment thereof with said processing fluid so that said image is not formed at or nearly at the other surface of said image-receiving layer;

means for establishing a light scattering pigment layer, having an index of refraction higher than said given index of refraction, intermediate said sheet-like element and said image-receiving layer, said image when formed being illuminated for viewing purposes by ambient light which first passes through the other surface of said image-receiving layer, then through said image-forming components and then reflected from said light scattering layer back through said image-forming components and out through said image-receiving layer, a portion of said ambient light being absorbed by said image-forming components subsequent to its being reflected by said light scattering layer; and a permanent, hardened, chemically inert, transparent optical barrier layer arranged to be located between said light scattering layer and said image, said optical barrier layer being composed of a material which is permeable with respect to said image-forming components so that said image-forming components may be diffused therethrough in the process of forming said image and which has an index of refraction no greater than that of said light scattering layer, said optical barrier layer being operative during viewing to reduce the amount of light absorption which would otherwise occur within said image-forming components absent said optical barrier layer, whereby the highlights of said image are brightened and the tone reproduction of said image improved compared with the appearance of said image absent said optical barrier layer.

4. The invention of claim 3 wherein said light scattering layer establishing means comprises light scattering pigments admixed with said processing fluid within said pod and wherein said optical barrier layer is impermeable with respect to said light scattering pigments as that they cannot diffuse therethrough.

5. The invention of claims 2 or 3 wherein said optical barrier layer is in direct contact with said light scattering layer.

6. The invention of claims 2 or 3 wherein said optical barrier layer has an index of refraction which is less than that of said light scattering layer.

7. The invention of claims 1, 2, or 3 wherein said optical barrier layer is at least 0.5 microns thick.

8. The invention of claims 1, 2, or 3 wherein said optical barrier layer comprises gelatin or cross-linked polyacrylamide, or hydroethylcellulose.

9. The invention of claim 8 wherein said light scattering layer comprises titanium dioxide.

10. In a process for forming, within a medium adapted to carry an image, an image of image-forming components which are diffused from an image recording element through a light scattering pigmented layer having a given index of refraction to an image-receiving layer having an index of refraction lower than said given index of refraction, the improvement comprising:

interposing a permanent, hardened, chemically inert transparent optical barrier layer, having an index of refraction no greater than the index of refraction of said light scattering layer intermediate said light scattering layer and said image-receiving layer, said optical barrier layer being composed of a material which is permeable with respect to said image-forming components to facilitate their diffusion and which is impermeable with respect to the pigments of said light scattering layer so that they cannot diffuse therethrough;

exposing said image recording element to image-carrying light rays to form therein a latent image of a subject; and treating said exposed image recording element with a processing fluid to cause image forming dyes to diffuse from said image recording element through said permanent, hardened, optical barrier layer and form a viewable image at or near the surface of said image-receiving layer facing said light scattering layer so that said viewable image is not disposed at or near the other surface of said image-recieving layer;

whereby said optical barrier layer operates to reduce the amount of light absorption which would otherwise occur within said image-forming components absent said optical barrier layer, when said image is viewed, the highlights of said image are brightened and the tone reproduction of said image improved compared with the appearance of said image absent said optical barrier layer.

* * * * *